US010480243B2

(12) United States Patent
Rafter et al.

(10) Patent No.: US 10,480,243 B2
(45) Date of Patent: Nov. 19, 2019

(54) TWO PIECE WINDOW EDGE CORNER SYSTEM AND METHOD FOR INSTALLATION

(71) Applicant: RC CREW, INC., Wichita, KS (US)

(72) Inventors: Thomas Rafter, Wichita, KS (US); Carl R. Whitmarsh, Owasso, OK (US)

(73) Assignee: RCREW, INC., Wichita, KS (US)

( * ) Notice: Subject to any disclaimer, the term of this patent is extended or adjusted under 35 U.S.C. 154(b) by 167 days.

(21) Appl. No.: 15/616,194

(22) Filed: Jun. 7, 2017

(65) Prior Publication Data

US 2018/0128039 A1 May 10, 2018

Related U.S. Application Data

(63) Continuation-in-part of application No. 15/147,596, filed on May 5, 2016, now abandoned, which is a (Continued)

(51) Int. Cl.

| | |
|---|---|
| ***E06B 5/11*** | (2006.01) |
| ***E06B 5/10*** | (2006.01) |
| ***E06B 3/96*** | (2006.01) |
| ***E06B 3/58*** | (2006.01) |
| ***E06B 3/964*** | (2006.01) |

(Continued)

(52) U.S. Cl.

CPC ..... *E06B 5/113* (2013.01); *E06B 3/5885* (2013.01); *E06B 3/96* (2013.01); *E06B 5/103* (2013.01); *E06B 5/106* (2013.01); *E06B 5/12* (2013.01); *F41H 5/0407* (2013.01); *F41H 5/26* (2013.01); *E06B 3/9641* (2013.01)

(58) Field of Classification Search

CPC . E06B 5/11; E06B 5/113; E06B 5/103; E06B 5/106; E06B 5/12; E06B 5/168; E06B 5/10; E06B 3/5885; E06B 3/5814; E06B 3/5821; E06B 3/96; E06B 3/9641; E06B 3/962; E06B 3/9644; E06B 3/9645; E06B 3/968; E06B 3/9681; E06B 3/9682; F41H 5/26; F41H 5/0407

USPC ..... 52/202, 203, 204.53, 204.62

See application file for complete search history.

(56) References Cited

U.S. PATENT DOCUMENTS 5,218,799 A * 6/1993 Appino ..... E06B 1/18 52/204.53

5,547,011 A * 8/1996 Dotson ..... E06B 9/24 160/371

(Continued)

*Primary Examiner* — Jessica L Laux

(74) *Attorney, Agent, or Firm* — Robert O. Blinn

(57) ABSTRACT

A break-in resistant window assembly whose components include a window pane having at least a pair of edges and a corner; a frame boarding the window pane; a sheet of polymeric film overlying the pane, a first adhesive layer fixedly interconnecting the pane and the sheet of polymeric film; and a corner assembly which includes a base portion and a cover portion which are able to be mechanically locked to each other to complete a corner assembly. The base portion includes adhesive pads for bonding both to the corner of the window pane and the corner of the window frame. Trim pieces which abut the base portion are also bonded to the window pane and the window frame by adhesive pads. The cover portion is arranged to extend over the abutting ends of the base portion and the trim pieces and thereby conceal any mismatch between those abutting edges.

3 Claims, 10 Drawing Sheets

Related U.S. Application Data continuation of application No. 14/520,981, filed on Oct. 22, 2014, now abandoned.

(60) Provisional application No. 61/895,918, filed on Oct. 25, 2013.

(51) Int. Cl.

| | |
|---|---|
| ***F41H 5/26*** | (2006.01) |
| ***F41H 5/04*** | (2006.01) |
| ***E06B 5/12*** | (2006.01) |

(56) References Cited

U.S. PATENT DOCUMENTS

| | | | | |
|---|---|---|---|---|
| 6,082,062 | A * | 7/2000 | Alflen | E06B 5/10 52/171.3 |
| 6,367,210 | B1 * | 4/2002 | Trundle | E06B 5/10 52/204.5 |
| 6,725,620 | B2 * | 4/2004 | Dai | E06B 3/5814 52/204.705 |
| 6,832,457 | B2 * | 12/2004 | Geiger | B60J 1/002 49/463 |
| 8,151,540 | B2 * | 4/2012 | Paz | E06B 5/10 52/202 |
| 9,222,299 | B2 * | 12/2015 | Haak | E06B 5/11 |
| 2011/0265387 | A1 * | 11/2011 | Giroux | B60J 1/007 49/479.1 |
| 2014/0262072 | A1 * | 9/2014 | Shives | E06B 3/485 160/201 |

* cited by examiner

TWO PIECE WINDOW EDGE CORNER SYSTEM AND METHOD FOR INSTALLATION

CROSS REFERENCES TO RELATED APPLICATIONS

This application is a continuation-in-part of U.S. non-provisional patent application Ser. No. 15/147,596 filed on May 5, 2016, which is incorporated herein by reference.

Application Ser. No. 15/147,596 was a continuation of U.S. non-provisional patent application Ser. No. 14/520,981 filed on Oct. 22, 2014, which is incorporated herein by reference.

U.S. non-provisional patent application Ser. No. 14/520,981 claimed the benefit of U.S. provisional application Ser. No. 61/895,918 filed on Oct. 25, 2013 which is incorporated herein by reference.

FIELD OF THE INVENTION

This invention relates to apparatus, articles, and assemblies which are adapted for protecting glass windows from breakage. More particularly, this invention relates to such assemblies which incorporate a polymeric or plastic transparent film applique as a reinforcing component.

BACKGROUND

Transparent polymeric or plastic films are known to be adhesively applied to the surfaces of transparent glass windows for purposes including window tinting, UV light filtering, maintenance of window screen integrity, and protection against inward projections of glass fragments and shards upon window breakage. Where additional protective measures are sought, transparent window films having thicknesses up to 400 micrometers or 1/62" are known to be adhesively applied to glass window surfaces, such thicker film appliques maintaining the integrity of the window glass as a barrier in events such as bomb blasts or impacts with storm driven debris.

Such thicker window film appliques are known to provide some protection against purposeful breakage by a burglar. However, such appliques by themselves are only marginally effective because burglars may consciously and purposefully direct strikes against the glass at and about its edges, breaking the window along its juncture with the window's frame. Such directed breakage by a burglar tends to inwardly separate both the glass window and its reinforcing film applique from the window frame, allowing the burglar's entry.

In order to enhance such thickened window film appliques' capacity for resisting impacts and breakage, trim strips are known to be provided and adhesively applied about the periphery of a film reinforced window. Such trim strips provide a structural reinforcing bridge or tie between the film which reinforces the window and the window's peripheral frame. Such additional window reinforcing trim strips are effective in maintaining a glass window's ability to remain in place and to continue to function as a screen or barrier upon experiencing a bomb blast or storm debris impacts. However, installations of such adhesively applied peripheral trim continue to be only marginally effective against purposeful efforts by burglars to gain access to buildings via window breakage. Such adhesively applied trim pieces typically include weak points at mitered corners, and burglars upon seeing such reinforcing trim, may concentrate blows at the window's corners. The typically mitered corners of such adhesively applied reinforcing trim tend to interrupt the structural continuity of the reinforcing trim about the periphery of the film reinforced window. Such mitered corners also undesirably invite a burglar's impacts at the window's corners and allow such impacts to successfully inwardly deflect the reinforced window.

The instant inventive window reinforcing assembly solves or ameliorates the problems, defects, and deficiencies described above, by incorporating within a polymeric film window reinforcement system, a specialized corner piece which markedly lessens corner zone structural weaknesses, and which effectively frustrates a burglar's efforts to break the reinforced window at the window's corner.

SUMMARY

A first structural component of the instant inventive window reinforcing assembly comprises at least a first, and preferably a plurality of corner pieces, each corner piece preferably being substantially "L" shaped, and having a pair of window frame contacting legs. In a preferred embodiment, each of the corner pieces' legs has a distal end, a window contacting face, and a frame contacting face. Also in the preferred embodiment, specially fitted trim engaging pins or lugs are fixedly attached to and extend distally from the legs' distal ends.

Further preferred structural components of the instant inventive assembly comprise adhesive pads attached to the corner pieces' window contacting and frame contacting faces.

Further structural components of the instant inventive assembly comprise at least a first, and preferably a pair of stop pin receiving sockets, such sockets preferably opening at the legs' flat window frame contacting faces.

In use of the instant inventive assembly and assuming that a window having a peripheral frame has been preliminarily reinforced by adhesively applied polymer coating or film, one of the corner pieces among the instant invention's plurality of corner pieces may be adhesively installed at each of the window's corners. In such installations, the adhesive pads located at the window contacting faces of the corner pieces' legs preferably directly contact and overlap the edges of the window's reinforcing film.

Where the corner pieces include stop pin reinforcing sockets, as is preferred, stop pins may be advantageously preliminarily installed at the window frame's corners. Such pins may comprise screw or bolt heads which are received within and engage the corner pieces' stop pin receiving sockets. Upon installation and engagements of such stop pins, a burglar's inwardly directed impacts at the corner of the reinforced window are resisted by structural ties which advantageously span between the window and its reinforcing trim and such stop pins. Such ties advantageously prevent inward deflections of the window at its corners.

In installation of the preferred embodiment of the assembly as described above, the fitted lugs or reinforcing pins which extend from the distal ends of the corner pieces' legs preferably nestingly extend into, and are adhesively bound within matching sockets or channels which open at the ends of conventional straight trim pieces, such straight pieces being installed about the periphery of the window.

Upon installation of the instant invention's reinforcing assembly in the manner described above, the corner piece components constitute, in the view of a burglar attempting to break the window, a structural equivalent of a prior art reinforced window which is inherently relatively weak at the corners. Such burglar may thereby be led to direct breaking impacts against the corners of the window pane. However, under the operation of the instant invention, such typically weak corner zones have been desirably transformed into zones of substantially increased strength and integrity. Accordingly, the instant inventive assembly operates to markedly increase the reinforced window's ability to resist break in efforts by burglars.

Accordingly, objects of the instant invention include the provision of a window reinforcing assembly which incorporates structures, as described above, and which arranges those structures in relation to each other, in manners described above, for the achievement of the objects, benefits, and advantages as described above.

Other and further objects, benefits, and advantages of the present invention will become known to those skilled in the art upon review of the Detailed Description which follows, and upon review of the appended drawings.

In a second embodiment of the window reinforcing assembly, a corner piece is provided which has a base portion and a cover portion. The base portion is arranged to fit into the corner of the window assembly essentially as does the corner piece described above for the first embodiment. The base portion includes extending legs which terminate at distal edges. In this example second embodiment, the base portion also preferably presents adhesive pads which are arranged on the surfaces of the base portion which are common to the corner of a window and the adjacent intersecting surfaces of a window frame. The adhesive pads are suitable for adhesively bonding the base portion to the corner of a window to which it is installed and to the adjacent intersecting corner surfaces of the window frame that is associated with the window. The cover portion is arranged so that it presents extending legs which terminate at distal edges which extend past the distal edges of the base portion. The distal ends of the cover portions have inside surfaces that match the corresponding outside surfaces of the trim pieces. Both the base portion and the cover portion have interlocking features so that, when the cover portion is pressed into the base portion, the cover portion and the base portion are locked together.

In the second embodiment, trim pieces may be roughly or approximately cut to length and installed between previously installed base portions of corner assemblies using adhesive pads as described above. Even if there is a gap between a distal end of a trim piece and an adjacent distal end of a leg of a base portion of a corner assembly, if the later installed cover portion of the corner assembly extends past the distal end of the trim piece so that the cover portion overlaps the distal end of the trim piece, then, when the cover portion is installed, the finished corner assembly will appear to be correctly mitered and properly finished. This provides a reinforced corner assembly which is attractive, yet very easy to install and yet also highly effective for securing a window as described for the first embodiment above.

DETAILED DESCRIPTION

Figure 1:
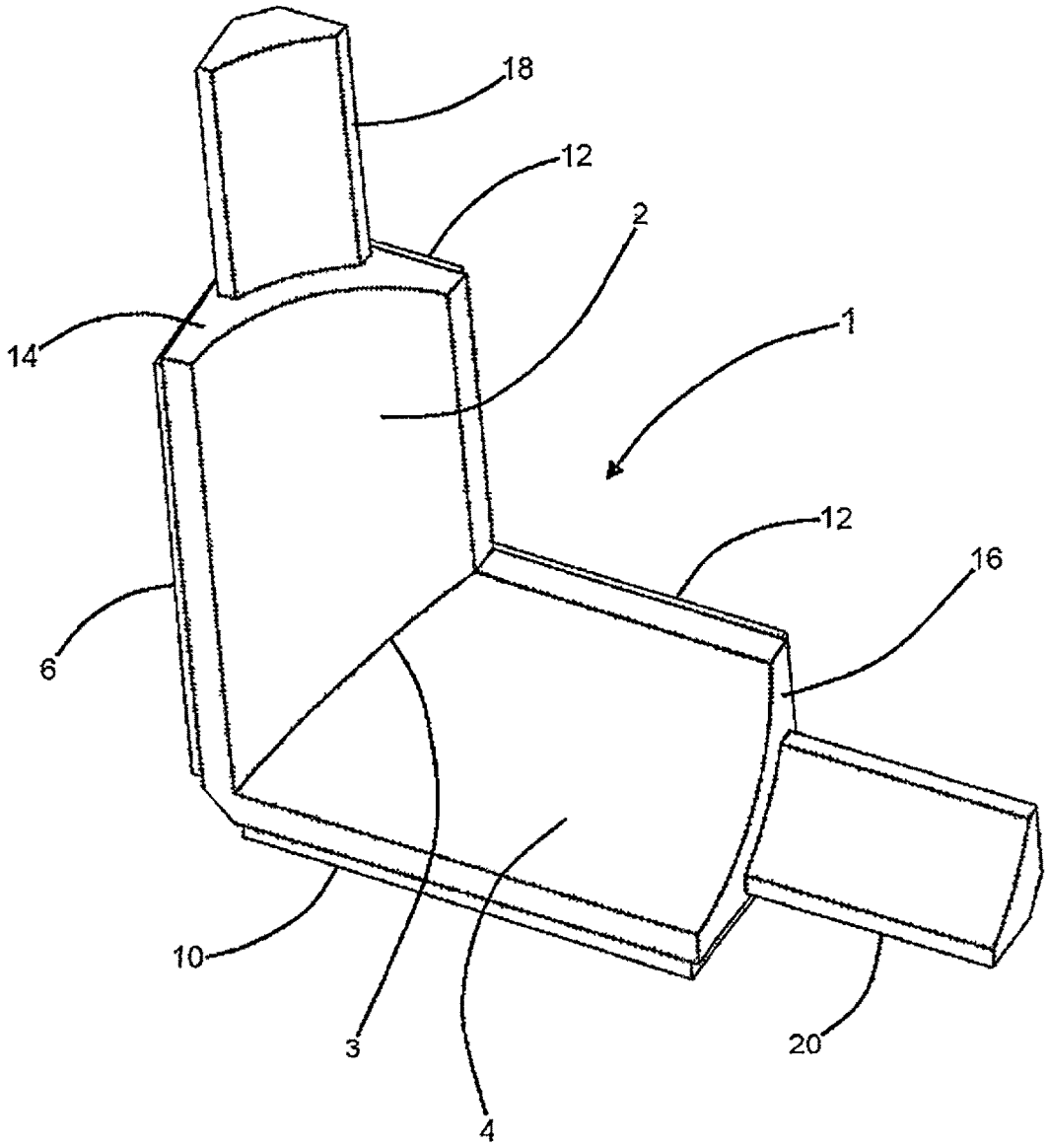
FIG. 1 is a view of a corner piece component of the instant inventive assembly.
Figure 2:
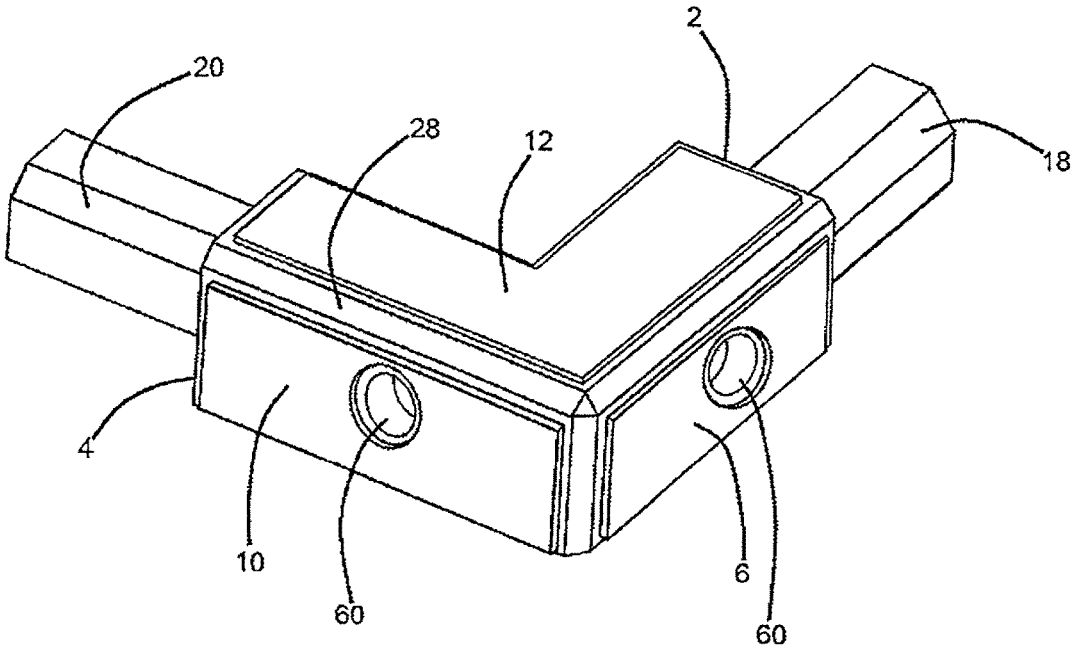
FIG. 2 is a reverse perspective view of the structure depicted in FIG. 1.

Referring now to the drawings, and in particular to Drawing FIGS. 1 and 2, a preferred embodiment of a corner piece component of the instant inventive assembly is referred to generally by Reference Arrow 1. The corner piece 1 preferably comprises a pair of distally extending legs 2 and 4 which are oriented at a 90 degree angle with respect to each other, and which include a faux mitered seam or juncture 3 therebetween at their proximal ends. An "L" shaped pressure actuated adhesive pad 12 or at least first adhesive pad is preferably adhesively attached to flat window contacting sides of the legs 2 and 4.

Figure 3:
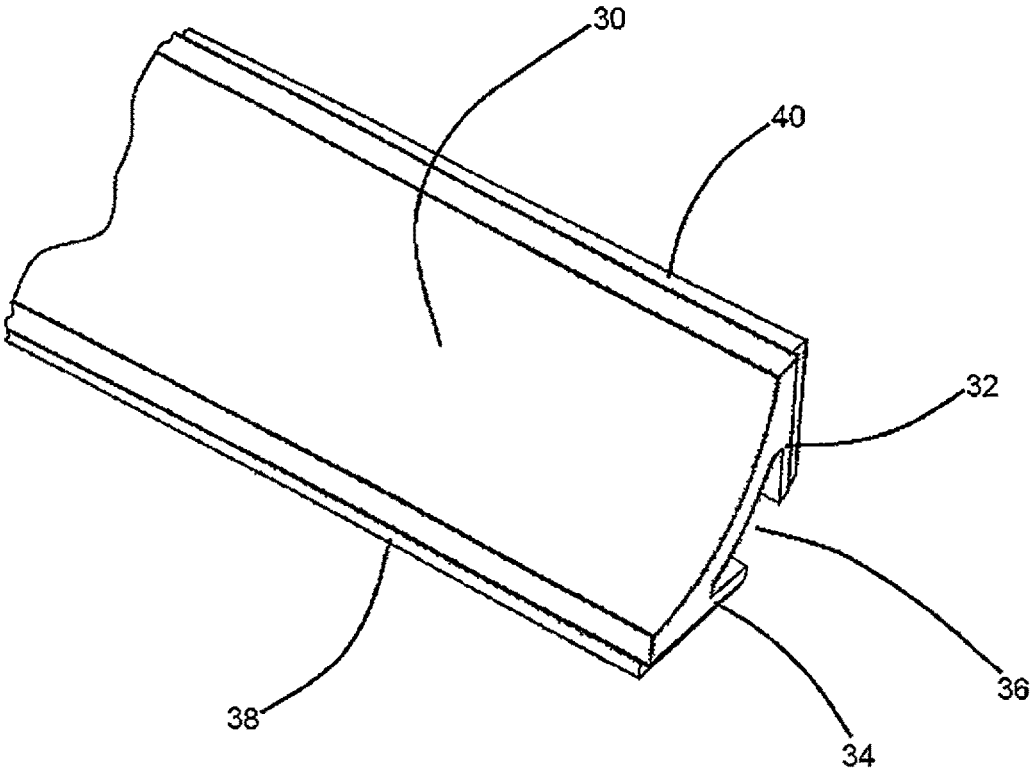
FIG. 3 is a perspective view of a length of prior art window reinforcing trim.

Referring simultaneously to FIGS. 1-3, lengths of prior art trim pieces 30 structurally correspond with the legs 2 or 4 of corner piece 1, such prior art trim pieces 30 having flat window frame contacting sides 32 and 34, and having adhesive pads 40 and 38, such pads constituting a plurality of second adhesive pads. The prior art trim pieces 30 conventionally form a hollow interior "C" channel which open at their proximal ends. Lugs or pins 18 and 20 which respectively distally extend from the distal ends 14 and 16 of the corner piece's legs 2 and 4 are preferably closely fitted for insertions into, and nesting receipts within such trim piece "C" channels 36. In a preferred embodiment, stop pin receiving sockets 60 open at third adhesive pads 6 and 10 and at the corner piece's window frame contacting faces.

Figure 4:
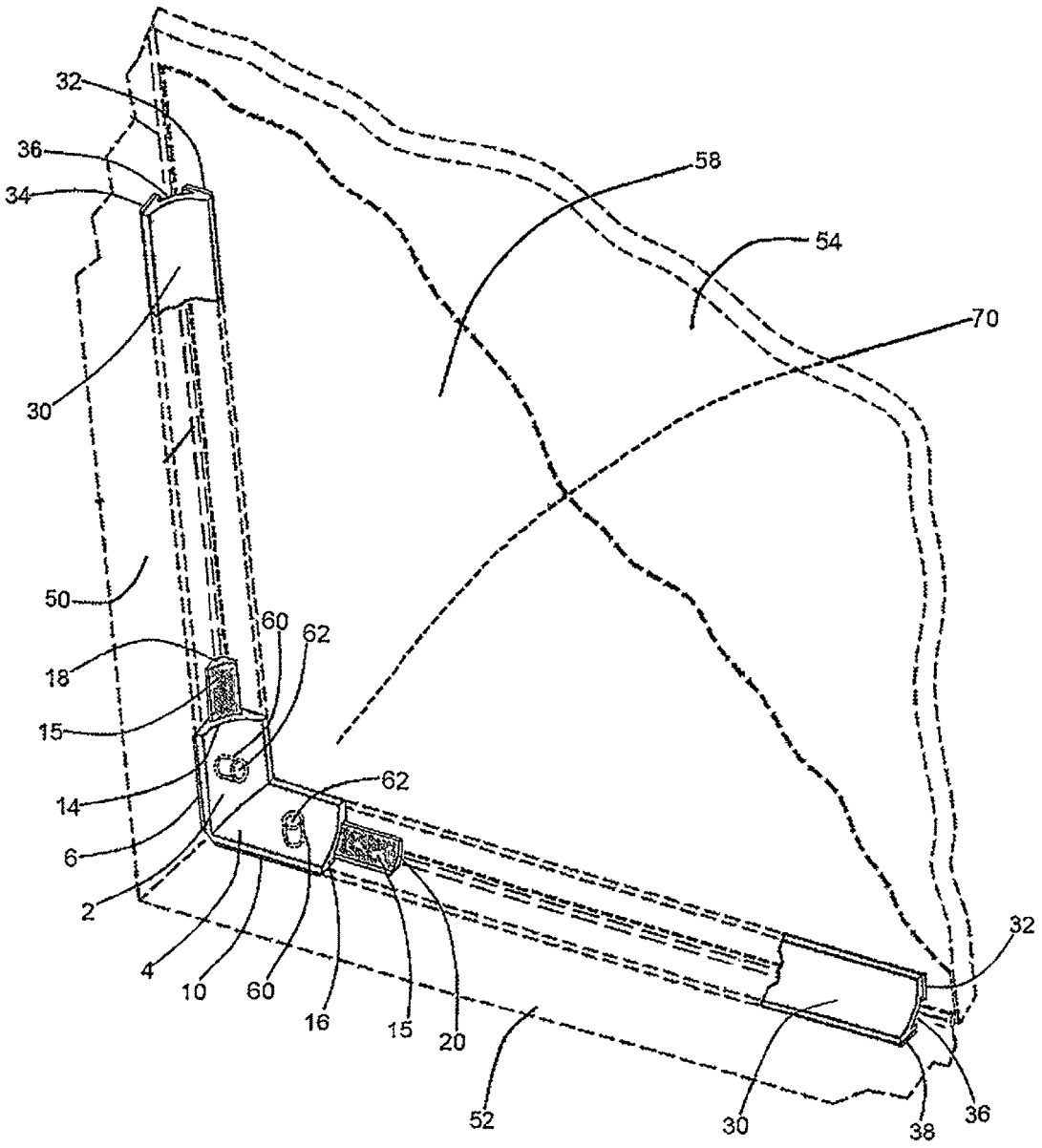
FIG. 4 shows the instant inventive assembly installed upon a polymeric film reinforced window.

In use of the instant inventive reinforcing assembly and referring in particular to FIG. 4, a glass window pane 54 mounted within a window frame 50, 52 may be preliminarily reinforced by a durable and transparent sheet of polymeric film 58, such polymeric film being adhesively applied by a first adhesive layer to the interior surface of window 54. Following installation of film 58, a pair of stop pins 62 may be preliminarily installed at each of the corners of the window frame 50,52, such pins 62 preferably being placed, referring further simultaneously to FIGS. 1-3, so that upon installation of a corner piece 1 as indicated in FIG. 4, sockets 60 nestingly receive and may engage pins 62. Upon configuration of the inventive assembly as indicated in FIG. 4, adhesive pad 12 securely attaches the corner piece 1 to film 58 and to window 54 while adhesive pads 6 and 10 correspondingly securely attach the corner piece 1 to the window frame 50.

In the preferred embodiment of the instant inventive assembly, and assuming that window film 58 and stop pins 62 have been preliminarily installed as indicated and depicted, a solvent based rubber cement 15 may be preliminarily disposed over the surfaces of pins 18 and 20, such dispositions 18 and 20 constituting second adhesive layers. Thereafter, straight lengths of reinforcing trim 30 may be installed along frame members 50 and 52. In such installations, the rubber cement 15 disposed over pins 18 and 20 initially functions as a lubricant which eases sliding installations of the straight lengths "C" channels 36 over the pins 18 and 20. Upon hardening of the rubber cement 15, the window reinforcing effect of straight lengths 30 advantageously continues at the corners of the window frame 50, 52 while the engagements of pins 62 within sockets 60 enhance the reinforcing strength of the system at the corners beyond the reinforcing strength provided by straight lengths 30. Such other corners of the window and frame components of the assembly constitute a plurality of second corners, and corner pieces similar to corner piece 1 which reinforce those second corners constitute a plurality of second corner pieces. Suitably, screws extending entirely through the corner pieces 1 may be provided in place of the inwardly hidden socket and pin combinations 62 and 60. However, use of such exposed corner piece mounting screws is less desirable because they may be viewed from the outside by a burglar who may undesirably detect and understand the corner reinforced nature of the reinforced window.

In operation of the instant inventive assembly, and referring simultaneously to all figures, a burglar located at the outside of window 54 may seek to gain ingress via breakage of such window. Such burglar, upon seeing trim pieces 30 extending about the periphery of the window 54, and upon seeing the faux mitered seam 3 of corner piece 1 may thereby be attracted or led to direct impacts against the window 54 at and about corner zone 70, such burglar erroneously believing that zone 70 constitutes a weak point in the window's reinforcing system. Breakage efforts directed against corner zone 70 of window 54 are desirably frustrated by the mechanically inter-linked adhesive pads 6, 10, and 12, pins 62, sockets 60, pins 18 and 20, and adhesive 15

Figure 5:
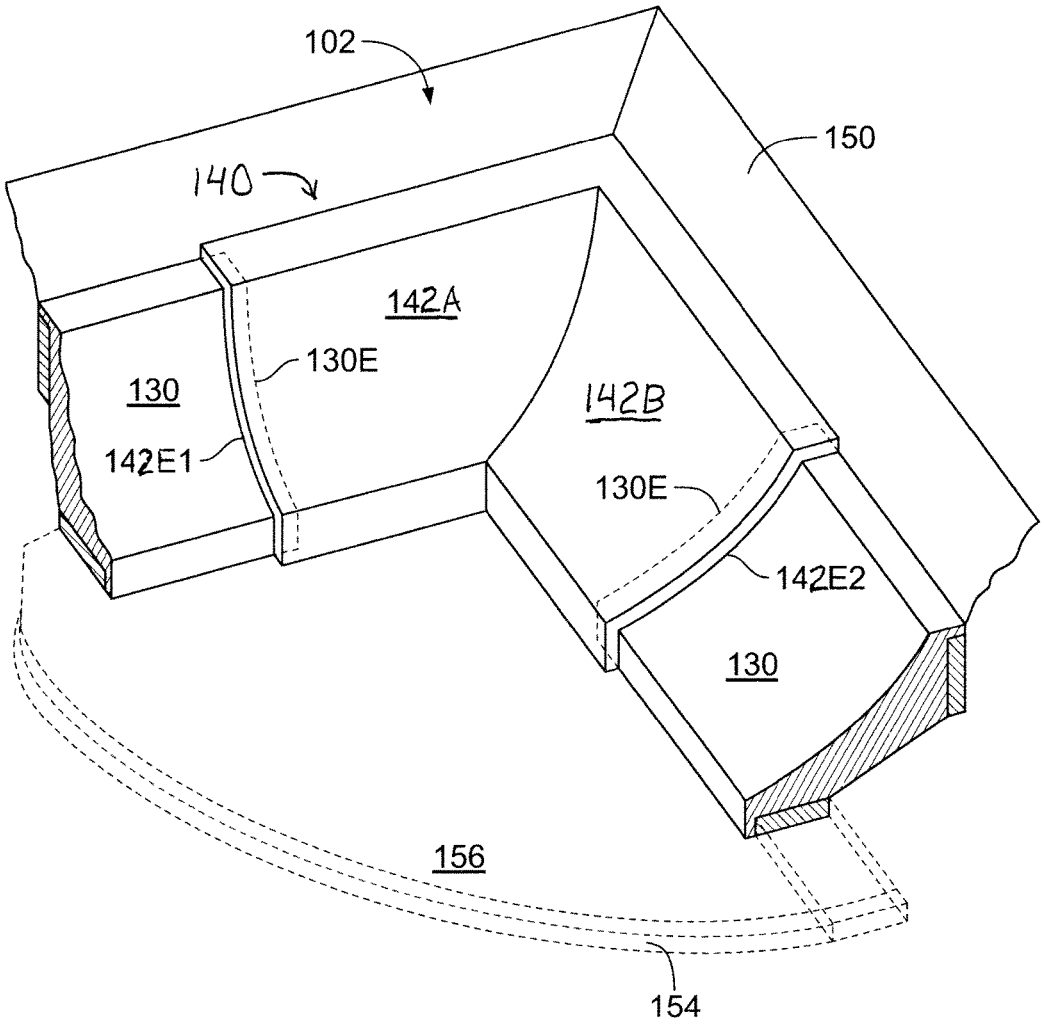
FIG. 5 is a perspective view a second embodiment of a reinforced window corner assembly installed upon a polymeric film reinforced window showing one corner.
Figure 6:
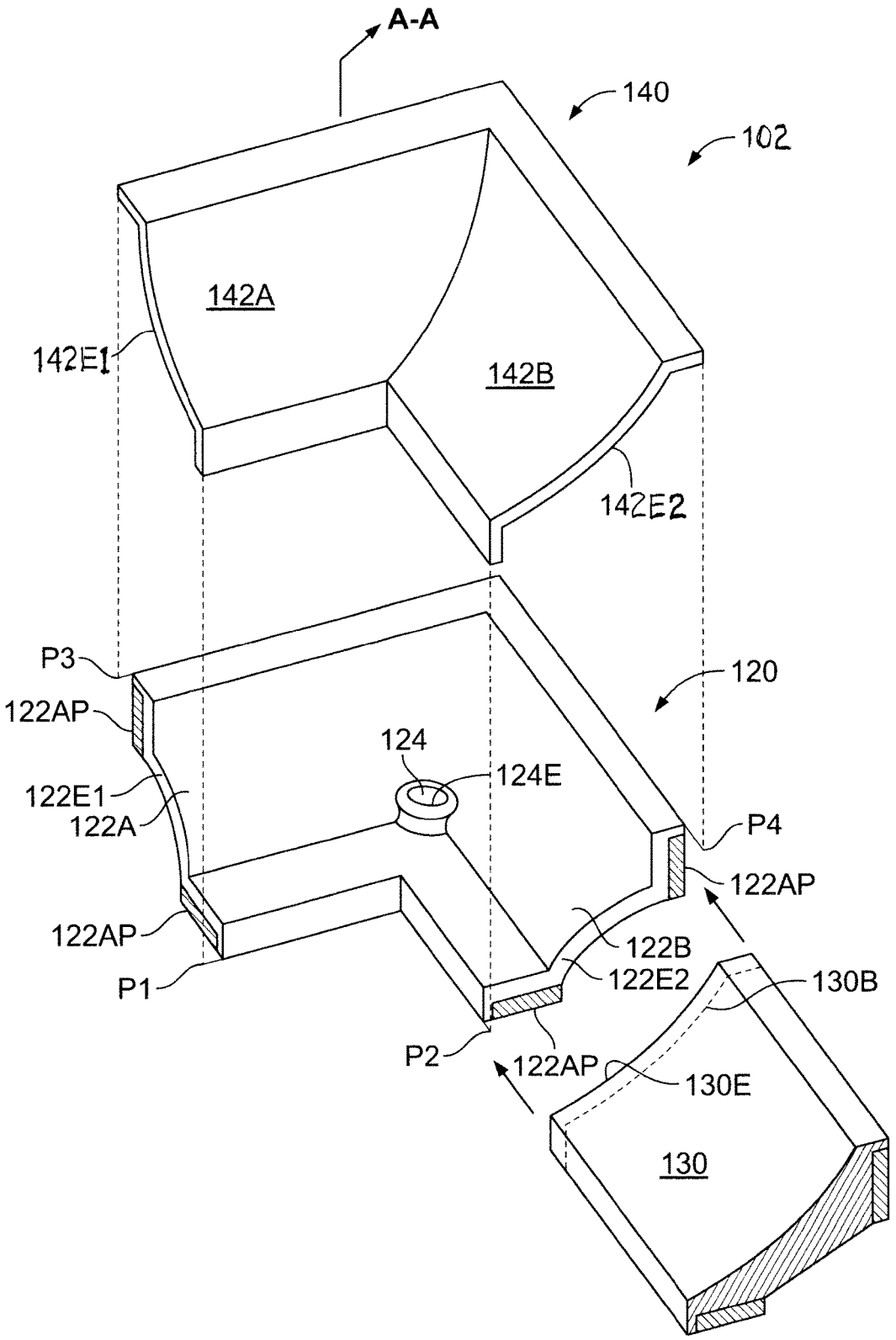
FIG. 6 is a partial exploded perspective view of the second embodiment of the reinforced window corner assembly installed upon a polymeric film reinforced window.

A second embodiment window corner reinforcing assembly 102 is shown in FIGS. 5-11. As can be seen in FIGS. 5 and 6, corner reinforcing assembly 102 is shown installed in the corner of a window 154 which is covered by a film 156 and which is mounted in a window frame 150. The skilled reader will appreciate that window 154, film 156 and frame 150 may be substantially identical to window 54, film 56 and window frame 50 described above and shown in FIG. 4. As can be seen in FIG. 6, corner reinforcing assembly 102 includes a base portion 120 and a cover portion 140. When assembled (as will be described in greater detail below) corner reinforcing assembly 102 is installed with trim pieces 130 which may be substantially identical to trim pieces 30 described above and shown in FIG. 4.

Figure 6A:
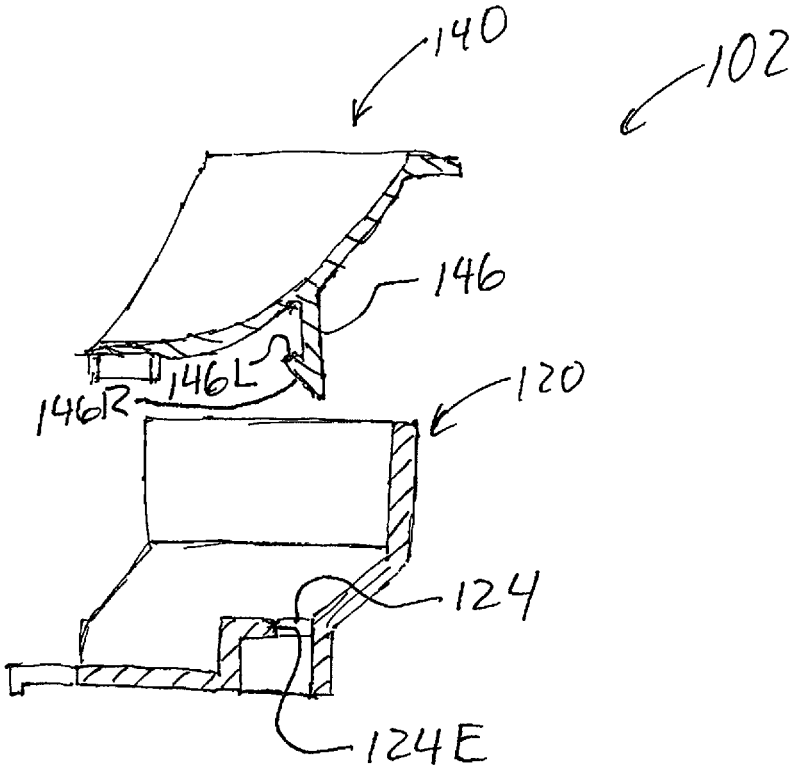
FIG. 6A is a cross section view taken from plane A-A of FIG. 6 of the second embodiment of the reinforced window corner assembly.
Figure 7:
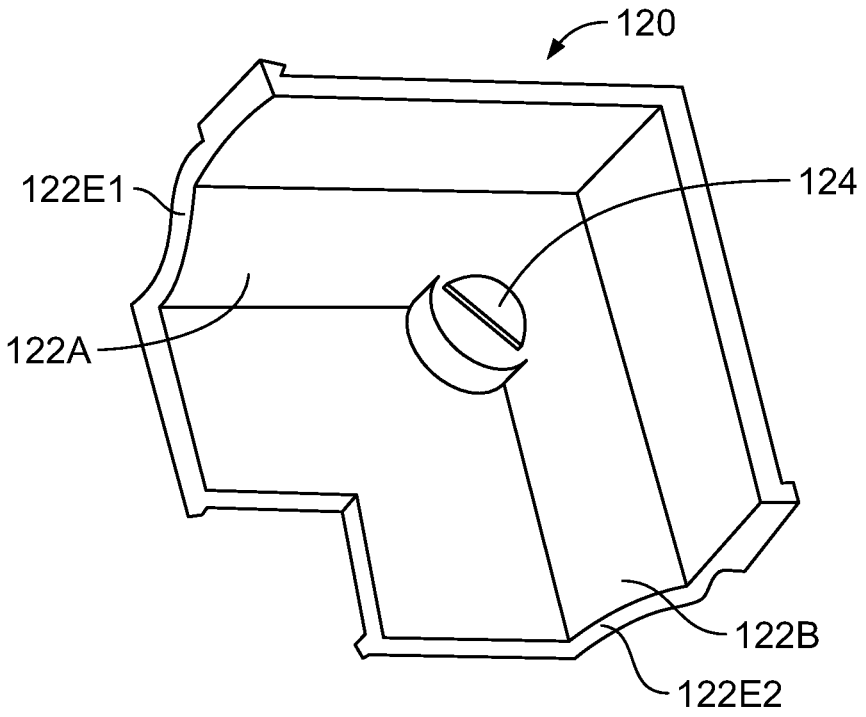
FIG. 7 is a first perspective view of a base portion of the second embodiment window corner assembly.
Figure 8:
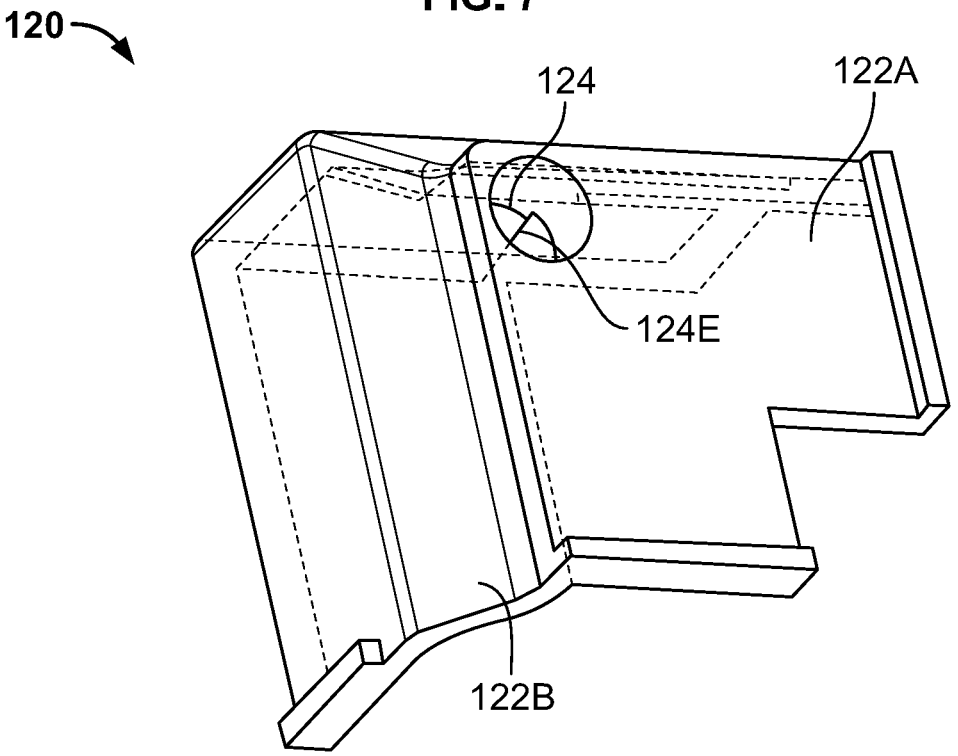
FIG. 8 is a second perspective view of the base portion of the second embodiment window corner assembly.
Figure 9:
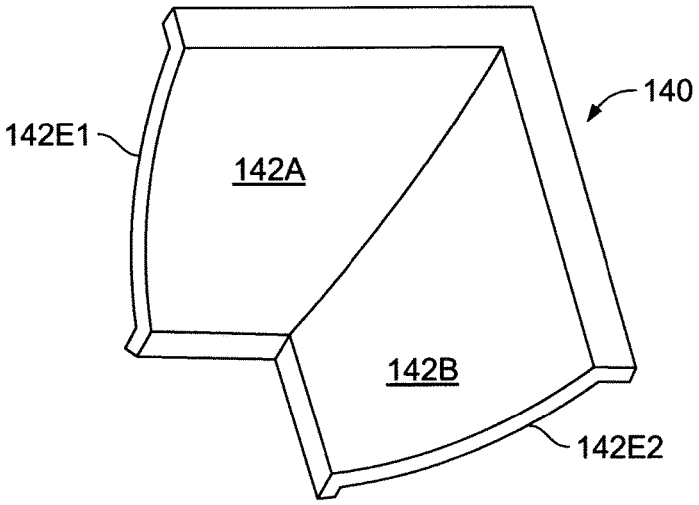
FIG. 9 is a first perspective view of a cover portion of the second embodiment window corner assembly.
Figure 10:
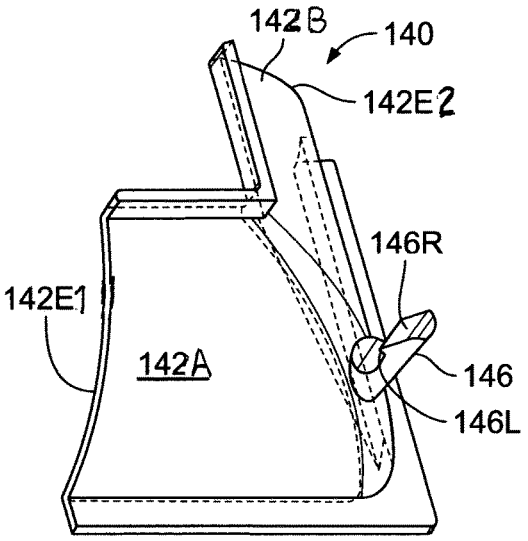
FIG. 10 is a second perspective view of the cover portion of the second embodiment window corner assembly.
Figure 11:
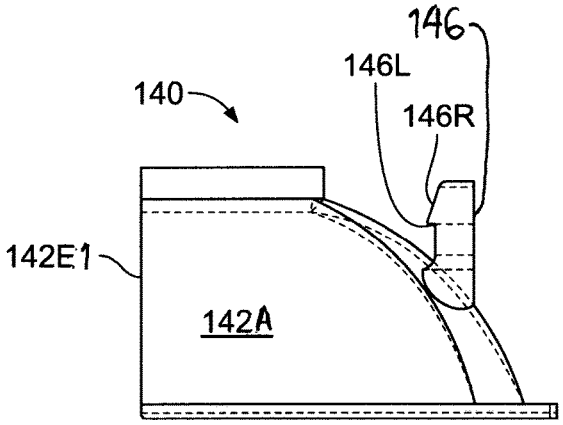
FIG. 11 is a side view of the cover portion of the second embodiment window corner assembly.

As can be best seen in FIGS. 6 and 6A base portion 120 has a generally right angle shape and presents two extending legs 122A and 122B. Each of legs 122A and 122B present flat surfaces for receiving adhesive pads 122AP (of a type well known in the art) that are suitable for bonding base portion 20 to both the surface of film 156 covering window 154 and the intersecting surfaces of window frame 150 as shown in FIG. 5. Extending legs 122A and 122B terminate at distal edges 122E1 and 122E2 respectively. As can be seen in FIG. 6, base portion 120 presents a catch opening 124 which is adapted for receiving a prong protruding from cover portion 140 as will be described in greater detail below. As can be seen in FIG. 6A, in this example, catch opening 124 presents an edge 124E which generally bisects a cylindrical opening 124.

Cover portion 140 also presents extending legs 142A and 142B that also terminate at distal edges 142E1 and 142E2 respectively. At least the distal ends of extending legs 142A and 142B are shaped so that the inside surfaces of distal edges 142E1 and 142E2 closely match the outside contours of trim pieces 130. Further, legs 142A and 142B extend such that the distal edges 142E1 and 142E2 will extend past the distal edges 122E1 and 122E2 of base portion 120 when cover portion 140 is fixed to base portion 120. Cover portion 140 also presents an attachment prong 146 which is arranged to be received by opening 124 of base portion 120.

Figure 5A:
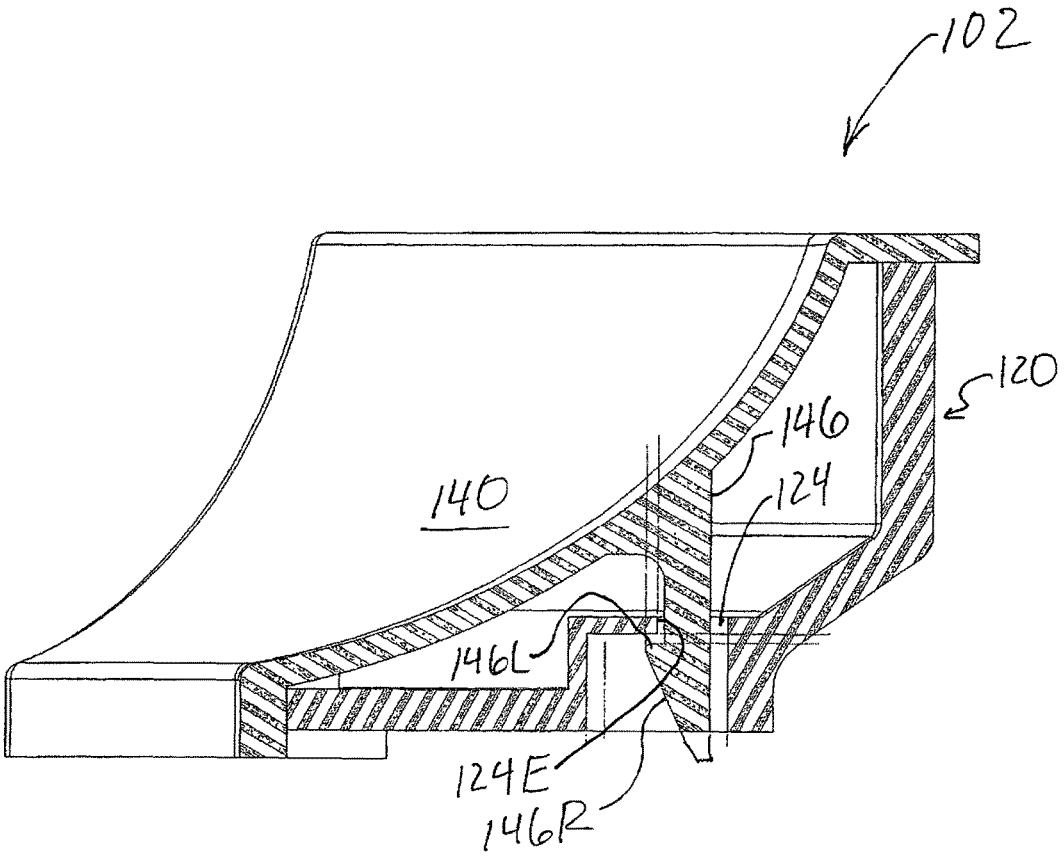
FIG. 5A is a cross section view taken from plane A-A of FIG. 5 of the second embodiment of the reinforced window corner assembly.

The interlocking engagement of attachment prong 146 of cover portion 140 and opening 124 of base portion 120 may be best understood by referring to FIGS. 6A and 5A. If such interlocking engagement occurs when base portion 120 is bonded to the corner of a window installation as described above, it is of the utmost importance that trim pieces 130 are also bonded in place as shown in FIG. 5. In FIG. 6A, attachment prong 146 is shown spaced away from catch opening 124. As can be seen in FIG. 6A, attachment prong 146 includes a ledge portion 146L and a ramp portion 146R. When cover is brought into engagement with base portion 120, ramp portion 146R of attachment prong 146 encounters edge 124E of catch opening 124 which causes attachment prong 146 to deflect away from edge 124E. When ledge 146L of prong 1110 attachment prong 146 clears the lower extent of edge 124E, prong 140 springs back so that ledge 146L extends under edge 124E. The resulting assembly is shown in FIG. 5A. At this point, if base portion 120 is bonded into the corner of a window and window frame, it will generally not be possible to disengage attachment prong 146 from opening 140 and thereby remove cover portion 140 from base portion 120.

As can be seen in FIG. 6, distal edges 142E1 and 142E2, when projected to align with base portion 120, extend to points P1, P2, P3 and P4. Points P1 and P2 are spaced away from distal edge 122E1 of base portion 120. Similarly, points P3 and P4 are also spaced away from distal edge 122E2 of base portion 120. Accordingly, cover portion 140 is sized to overlap to a border 130B which is indicated in FIG. 6 on the upper surface of trim piece 130. The same overlap will occur on a trim piece 130 installed on the other side of base portion 120 as shown in FIG. 5. Because of this overlap, when trim pieces 130 are cut to length and installed between opposite corner assemblies 102, the opposite ends of such a trim piece 130 do not need to abut precisely against distal edges 122E1 and 122E2 of base portions 120 of each of the opposite corner assembly 102. If the length of a trim piece 130 falls short of the distance between opposite faces of the base portions 120 by, for example, less than half of overlap 130B indicated in FIG. 6, then cover portions 140 will easily conceal the mismatch. This greatly decreases the skill and precision needed to install corner assemblies 102 and trim pieces 130.

Installing the second embodiment assembly which includes corner assemblies 102 may be best understood by referring to FIG. 6. Once adhesive film 156 has been properly installed on window pane 154, base portions such as base portion 120 may be installed in each of the four corners of a window assembly. Preferably each base portion has adhesive pads such as adhesive pads 122AP shown in FIG. 6 which are arranged to bond base portion 120 to both the corner of film 156 at the corner of the window assembly and the intersecting sides of the window frame. Next, trim pieces 130 are installed between base portions 120. Preferably, trim pieces 130 are cut so that they extend substantially the entire distance between the opposite edges of the base portions at opposite corners of the window pane on one of the sides of the window pane. Also preferably (or at least in this example), the outside contours of trim pieces 130 match the outside contours of base portions 120 to which they abut. Trim pieces 130 are bonded to the edges of film 156 (which is bonded to and which overlays window pane 154) and to each adjacent face of the window frame. Finally, cover portions 140 are snapped down onto base portions 120 as each attachment prong 146 of each cover portion 140 engages and interlocks with each corresponding opening 124 of each base portion 120 to complete the each corner reinforcing assembly 102. Because the distal edges of the legs of cover portions 140 extend past the distal edges of its corresponding base portions 120, the cover portions cover and conceal any gaps which sufficiently narrow gaps that may occur between the abutting edges of base portions 120 and trim pieces 130. Thus, the finished assembly has a well finished appearance even if there are imperfections in the mitering of trim pieces 130.

The preferred material for both base portion 120 and cover portion 140 would be a suitable type of injection molded plastic. Preferably, a material should be selected so that attachment prong 146 of cover portion 140 would be strong, yet have sufficient flexibility so that it is able deflect in order to capture edge 124E of opening 124 of base portion 120.

As can be understood from the above detailed description, corner assembly 110 provides a way to fashion finished corners for connecting window trim pieces to provide effective and attractive edge reinforcements for window panes to which break-in resistant films have been applied. As noted above, with the corner system described immediately above, minimal mitering effort and precision are required for fashioning window trim pieces for a reinforced window.

While the principles of the invention have been made clear in the above illustrative embodiment, those skilled in the art may make modifications in the structure, arrangement, portions and components of the invention without departing from those principles. Accordingly, it is intended that the description and drawings be interpreted as illustrative and not in the limiting sense, and that the invention be given a scope commensurate with the appended claims.

Having thus described the invention, what is claimed as new and desired to be secured by Letters Patent is:

1. A break-in resistant window assembly comprising:

a window pane having at least one corner;

a window frame bordering the window pane that has at least one corner, the at least one corner including intersecting frame surfaces;

a sheet of polymeric film overlying the window pane that is adhesively bonded to the window pane;

a corner reinforcing assembly including a base portion and a cover portion, the base portion presenting two legs that extend at right angles with respect to each other such that each terminates at a distal end, each leg presenting flat surfaces for receiving adhesive pads that are suitable for bonding the base portion to both the surface of the polymeric film covering the window pane and the intersecting surfaces of window frame, the base portion also presenting an engaging feature, the cover portion being shaped and sized to cover the base portion, the cover portion also presenting a pair of legs, each leg having a distal end that presents a distal edge, the cover portion also presenting an engaging feature that is suitable for engaging the engaging feature of the base portion for fixing the cover portion to the base portion, the legs of the cover portion being arranged such that distal edges of the legs of the cover portion extend beyond the distal edges of the legs of the base portion when the base portion and the cover portion are assembled into a corner reinforcing assembly;

a pair of trim pieces having distal ends that present distal edges;

adhesive pads attaching the trim pieces to the window frame and adhesive pads further attaching the trim pieces to the sheet of polymeric film covering the window pane, the trim pieces being of sufficient length so that when the trim pieces are installed adjacent to the base portion of the corner assembly and when the cover portion is mounted to the base portion, the distal edges of the legs of the cover portion extend over the distal edges of the trim pieces so that the distal edge of the trim piece is concealed under the cover portion of the corner reinforcing assembly.

2. The break-in resistant window assembly of claim 1 wherein the base portion and the cover portion of the corner assembly are fashioned from injection molded plastic.

3. The break-in resistant window assembly of claim 2 wherein the engaging feature of the base portion is a catch opening that presents an inside edge and the engaging feature of the cover portion of the corner assembly is prong that presents an undercut edge that receives the edge of the catch opening of the base portion to complete locking engagement between the cover portion and the base portion.

* * * * *